United States Patent [19]

Barr

[11] 4,275,051

[45] Jun. 23, 1981

[54] SPIN SIZE AND THERMOSETTING AID FOR PITCH FIBERS

[75] Inventor: John B. Barr, Strongsville, Ohio

[73] Assignee: Union Carbide Corporation, New York, N.Y.

[21] Appl. No.: 7,321

[22] Filed: Jan. 29, 1979

[51] Int. Cl.[3] ..... D01F 9/12

[52] U.S. Cl. ..... 423/447.4; 264/29.2; 264/130; 423/447.5

[58] Field of Search ..... 423/447.2, 447.4, 447.5; 264/29.2, 29.5, 132, 130, 131; 8/115.5

[56] References Cited

U.S. PATENT DOCUMENTS

| | | | |
|---|---|---|---|
| 2,550,838 | 5/1951 | Macq | 264/130 |
| 3,497,318 | 2/1970 | Noss | 423/447.5 |
| 3,508,874 | 4/1970 | Rulison | 423/447.2 |
| 3,552,922 | 1/1971 | Ishikawa et al. | 423/447.4 |
| 3,594,455 | 7/1971 | Polovoi et al. | 264/29.5 |
| 3,997,638 | 12/1976 | Manning et al. | 423/447.4 |
| 3,997,654 | 12/1976 | Kolling et al. | 423/447.2 |
| 4,005,783 | 1/1977 | Singer | 423/447.2 |
| 4,020,145 | 4/1977 | Soehngen et al. | 423/447.4 |
| 4,024,227 | 5/1977 | Kishimoto et al. | 423/447.4 |

FOREIGN PATENT DOCUMENTS

| | | | |
|---|---|---|---|
| 51-12740 | 4/1976 | Japan | 264/29.2 |
| 168848 | 11/1965 | U.S.S.R. . | |

*Primary Examiner*—Jay H. Woo
*Attorney, Agent, or Firm*—John R. Doherty

[57] ABSTRACT

A method of treating a multifilament bundle of pitch fibers, such as yarn or tow, to prepare such multifilament bundle for further processing which comprises applying to the fibers thereof an aqueous finishing composition comprising a dispersion of graphite or carbon black in water in which is dissolved a water-soluble oxidizing agent and a water-soluble surfactant. The finishing composition serves as both a size for the fiber bundle and as a thermosetting aid during infusibilization of the fibers.

12 Claims, No Drawings

SPIN SIZE AND THERMOSETTING AID FOR PITCH FIBERS

BACKGROUND OF THE INVENTION

This invention relates to a spin size and thermosetting aid for pitch fibers.

In order to convert pitch fibers into carbon fibers it is necessary to first thermoset them before they can be carbonized to produce the desired final product. Generally, such fibers are spun and further processed into carbon in the form of multifilament yarn or tow. Because of the exothermic nature of pitch oxidation, however, hot spots often develop in the multifilament bundle during thermosetting which cause the fibers to melt or soften before they become infusibilized. As a result of this, deformation of the individual filaments occurs along with exudation of molten pitch through the filament surfaces which causes them to stick together at various points of contact along the length of the yarn or tow. This deformation and sticking of the fibers in turn causes the yarn or tow to become stiff and brittle and to suffer a loss of flexibility and tensile strength. As a result, such yarn or tow cannot be further processed without breaking a large number of filaments.

Spin sizes are conventionally applied to pitch fiber yarn or tow immediately following spinning in order to maintain the integrity of the yarn or tow, to provide lubricity at the filament-to-filament interfaces, and to impart abrasion resistance to the filament bundle. However, while such sizes improve the handleability of the yarn or tow prior to thermosetting, they often are of no value, or only of limited value, during thermosetting. Thus, for example, while mixtures of plain water and glycerol impart good handling properties to as-spun pitch fiber yarn or tow, such yarn or tow is still subject to the same disadvantages encountered during thermosetting of unsized yarn or tow, i.e., melting and sticking of the fibers often occurs which causes a reduction of the flexibility and tensile strength of the fiber bundle.

One attempt to overcome the sticking problem encountered during thermosetting is disclosed in U.S.S.R. Pat. No. 168,848. The approach to the problem suggested in that reference is to fan the filaments with coal dust prior to thermosetting. However, not only is this method dirty and inconvenient, but it is also very difficult to apply a uniform layer of particles to the filaments by this technique. Furthermore, because coal has a high inorganic impurity content, significant pitting of the fiber surfaces occurs during oxidation which is accompanied by a concomitant reduction in the strength of the fibers after carbonization.

A similar attempt to surmount the sticking problem and at the same time accelerate oxidation of pitch fibers is disclosed in U.S. Pat. No. 3,997,654 wherein it is suggested that the fibers be dusted with activated carbon which has been impregnated with an oxidizing agent. However, this procedure appears to suffer from the same disadvantages as the process of U.S.S.R. Pat. No. 168,848. Furthermore, because of the hardness and large size of the particles employed (60 microns), this procedure does not provide sufficient separation of the filament bundle to allow maximum contact of the oxidizing gas with the fiber surfaces or provide sufficient lubricity between the fibers to prevent physical damage to the fiber surfaces.

SUMMARY OF THE INVENTION

The present invention provides a method of treating a multifilament bundle of pitch fibers, such as yarn or tow, to prepare such multifilament bundle for further processing which comprises applying to the fibers thereof an aqueous finishing composition comprising a dispersion of graphite or carbon black in water in which is dissolved a first compound comprising a water-soluble oxidizing agent and a separate second compound comprising a water-soluble surfactant.

DESCRIPTION OF THE PREFERRED EMBODIMENTS

The aqueous dispersion employed to treat a multifilament bundle of pitch fibers according to the present invention serves as both a size for the bundle and as an effective thermosetting aid during the infusibilization step which must be conducted before the fibers can be carbonized to produce the desired product. Because the graphite or carbon black particles are applied as a finely-divided dispersion, more effective penetration of these particles between the filaments of the bundle is achieved. As a result of this increased pentration of the particles, greater lubricity is provided between the filaments which helps prevent physical damage to the fiber surfaces during subsequent processing. In addition, the separation of the fiber bundle caused by the infiltration of these minute particles between the filaments allows improved penetration of the oxidizing gas into the bundle during thermosetting, which helps reduce oxidation time and the exothermic excursion and filament fusion which ordinarily occurs at that time. As noted previously, such fusion reduces the flexibility and tensile strength of the yarn or tow.

Either finely-divided graphite or carbon black can be employed in the dispersions employed in the present invention. Materials such as activated carbon and coal are undesirable because they are abrasive and contain a high amount of inorganic impurities (usually several percent) which is known to cause pitting of the fiber surfaces during oxidation and a concomitant loss of fiber strength. For this reason, it is preferable to use graphite or carbon black as they are softer, more slippery materials and are available in a relatively pure state compared to other carbonaceous materials. For best results, the graphite or carbon black should contain less than 0.5 percent by weight of inorganic impurities. This inorganic impurity content is usually measured by determining the ash content of such materials.

Any form of carbon black, e.g., gas blacks, furnace combustion blacks, furnace thermal blacks, lampblacks, may be employed in the dispersions of the present invention. Likewise, any form of graphite, either natural or synthetic, can be employed. In order to allow maximum penetration of such particles between the filaments of the fiber bundle, they should be no greater than 15 microns in size. Preferably, they have a size of from 0.3 micron to 5 microns. Because of the small size of these particles, they readily infiltrate the fiber bundle and uniformly coat the filaments. When the fiber bundle is further processed, these soft and slippery particles readily slide over each other and over the filaments so that the fibers are less subject to breakage and damage. Furthermore, the separation of the fiber bundle caused by the infiltration of these minute particles between the filaments facilitates permeation of the oxidizing gas into the bundle during thermosetting. This increased permeation of oxygen into the fiber bundle reduces the oxidation time and allows the fibers to be processed at greatly increased speeds. Ordinarily, unless filament packing in the fiber bundle is kept low and the oxidation process is very gradual, an exotherm excursion occurs during oxidation which causes fusion of the filaments to occur. Because of the separation of the fiber bundle caused by the infiltration of the graphite or carbon black particles between the filaments, however, the filament surfaces are brought into contact with the oxidizing gas to a greater extent during oxidation and such heat excursion is prevented. As a result, the fibers can be more rapidly oxidized without the fusion and filament sticking which formerly occurred. Thus, throughput speeds of at least 1.5 times that formerly attained without the use of such dispersions are now possible without loss of fiber properties. As a result, production capacity and the economics of the process have been greatly improved.

By adjusting the concentration and wetting characteristics of the dispersion employed in the present invention, it is possible to control the amount of graphite or carbon black which is deposited on the pitch fiber bundle. Generally, the dispersion contains from about 0.1 part by weight to about 10 parts by weight of graphite or carbon black per 100 parts by weight of mixture, preferably from 1 part by weight to 6 parts by weight of graphite or carbon black per 100 parts by weight of mixture.

Any water-soluble compound which is capable of functioning as an oxidizing agent at the temperature at which thermosetting is effected can be employed as a thermosetting aid in the aqueous dispersions employed in the present invention, provided such compound does not cause the suspension to flocculate. Because the compounds employed are water soluble, their physical presence on the fiber surfaces during thermosetting is assured. Oxidation and infusibilization of the fibers is thereby enhanced during thermosetting, allowing the fibers to be processed at greatly increased speeds. Suitable oxidizing agents include peroxygenated compounds, for example, peroxides, persulfates, pyrosulfates, and perchlorates. Among the compunds which can be employed are sodium peroxide, potassium peroxide, sodium persulfate, potassium persulfate, sodium pyrosulfate, potassium pyrosulfate, sodium perchlorate, potassium perchlorate, and magnesium perchlorate. Sulfates, sulfites, bisuflites, sulfamates, and nitrates are also suitable, including, for example, sodium sulfate, potassium sulfate, sodium sulfite, potassium sulfite, sodium bisulfite, potassium bisulfite, sodium sulfamate, potassium sulfamate, sodium nitrate, and potassium nitrate. However, because such salts leave residues on the fibers and may cause pitting of the fiber surfaces during oxidation, it is preferred to use the corresponding ammonium salts or such compounds as hydrogen peroxide and sulfamic acid. Certain oxidizing agents which also act as a surfactant are not employed, however, because a surfactant is otherwise provided in the dispersion.

Any water-soluble surfactant can be employed in the aqueous dispersions employed in the present invention, provided such surfactant does not cause the suspension to flocculate. Anionic and nonionic surfactants are preferred for this reason. Such surfactants serve to increase wetting of the fibers by the dispersion by reducing the surface tension of the water, thereby promoting the distribution of the graphite or carbon black throughout the fiber bundle. As a result, oxidation and infusibilization of the fibers during thermosetting is enhanced and the fibers can be processed at greatly increased speeds. Suitable surfactants include tetramethyl sodium oleate, tetramethyl sodium laurate, sodium laruate, and the like. However, because such salts leave resiudes on the fibers and may cause pitting of the fiber surfaces during oxidation, it is preferred to use the corresponding ammonium salts. Certain surfactants which also act as an oxidizing agent are not employed because an oxidizing agent is otherwise provided in the dispersion.

Generally, an amount of surfactant is employed which will impart a surface tension of less than about 50 dynes/cm. to the dispersion, preferably less than about 40 dynes/cm. The amount of oxidizing agent employed should not exceed an amount which will destroy the stability of such dispersion. Generally, from about 0.1 part by weight to about 2.0 parts by weight, preferably from about 0.2 part by weight to about 0.8 part by weight, per 100 parts by weight of mixture are satisfactory. If necessary, a suitable dispersing agent may be employed to facilitate dispersion of the graphite or carbon black in the water and maintenance of the dispersion. Suitable stabilizers, film formers, etc., may also be employed if desired.

After the dispersion has been formed, it is applied to the fibers by an convenient means, such as by spraying, brushing, rolling, or simply by immersing the fibers in the dispersion. A convenient means of applying the dispersion to the fibers is to pass the fibers over a sizing wheel which rotates in a bath of the dispersion and is coated with the dispersion. This, preferably, is done as the fibers emerge from the spinnerette. By controlling the size and speed of the wheel it is possible to control the amount of the dispersion which is applied to the fibers. In any event, the fibers should be allowed to absorb a sufficient amount of the suspension to provide from about 0.1 gram of the dispersion to about 1.5 grams of the dispersion per gram of fiber.

The fibers treated in this manner are then thermoset in a conventional manner by heating in an oxygen-containing atmosphere, such as pure oxygen or air. Drying of the fibers is not necessary and the fibers can be thermoset while still wet if desired. Such thermosetting, of course, must be carried out at a temperature below the temperature at which the fibers soften or distort. Because the thermosetting action of the oxidizing agent employed usually commences at a temperature below 200° C. where the rate of oxidation is ordinarily quite slow, infusibilization can usually be effected at lower temperatures than are normally required, or in shorter periods of time than are normally required. While the time required to oxidize the fibers to the desired degree will vary with such factors as the particular oxidizing atmosphere, the temperature employed, the diameter of the fibers, and the particular pitch from which the fibers were prepared, at any given temperature such time is usually less than two-thirds of the time required when the fibers are not treated with the dispersions of the present invention.

The thermoset fibers may then be carbonized in a conventional manner by heating them in an inert atmosphere to a temperature sufficiently elevated to remove hydrogen and other carbonizable by-products and produce a substantially all-carbon fiber. Fibers having a carbon content greater than about 98 percent by weight can generally be produced by heating to a temperature in excess of about 1000° C., and at temperatures in excess of about 1500° C. the fibers are completely carbonized. Generally, carbonization times of from about 2 seconds to about 1 minute are sufficient.

If desired, the carbonized fibers may be further heated in an inert atmosphere to a graphitization temperature, e.g., from about 2500° C. to about 3300° C.

Pitch fibers suitable for use in the present invention can be prepared in accordance with well-known techniques. Preferably, the fibers employed are prepared from mesophase pitch as described in U.S. Pat. No. 4,005,183.

While the invention has been described with reference to pitch fiber yarn or tow, it should be apparent that fibers of other carbonizable organic polymeric materials, such as homopolymers and interpolymers or acrylonitrile, can be treated in a similar manner.

The following examples are set forth for purposes of illustration so that those skilled in the art may better understand this invention. It should be understood, however, that they are exemplary only, and should not be construed as limiting this invention in any manner. Tensile strength and pull strength properties referred to in the examples and throughout the specification were determined as described below unless otherwise specified.

TENSILE STRENGTH

Tensile strength was determined on an Instron testing machine at a cross-head speed of 0.02 cm/min. All measurements were made on 10-inch length unidirectional fiber-epoxy composites.

PULL STRENGTH

Pull strength was determined on Mechanical Force Gage Model D-20-T, manufactured by Hunter Spring Co., Hatfield, Pa., a division of Ametak Inc. The filament or filament bundle to be tested is passed over a pulley which is attached by means of a spring to a gauge designed to record the force in pounds exerted on the pulley. Both ends of the filament or filament bundle are then wrapped around a mandrel which is suspended from the pulley by means of the filament or filament bundle. Typically, a distance of from about 3 to 12 inches is provided between the pulley and the mandrel. Tension is then exerted on the filament or filament bundle by pulling down on the mandrel until the yarn breaks. The total force in pounds required to break the filament or filament bundle is recorded on the gauge. This force is designated as the pull strength of the filament or filament bundle.

EXAMPLE 1

Continuous pitch filaments were spun through two 1000 hole hot melt spinnerettes from a 322° C. softening point mesophase pitch having a mesophase content of 77 percent. The capillary holes of the spinnerette were 4 mils in diameter and 8 mils in length. As the filaments emerged from the spinnerette, they were combined into a single bundle which was drawn down over a sizing wheel which rotated in a bath containing a suspension of carbon black flour in and aqueous solution of ammonium persulfate and ammonium laurate. The fibers were spread over the slowly rotating wheel as they were brought into contact with it and were thoroughly wetted by and uniformly coated with the suspension by this procedure. The coated fibers were then collimated into a yarn by means of a gathering wheel having a "V" slot, and subsequently drawn down to a diameter of about 14 microns by means of two godet wheels.

The suspension employed to coat the fibers contained 3.6 parts by weight of carbon black, 0.8 part by weight of ammonium persulfate, and 0.4 part by weight of ammonium laurate per 100 parts by weight of mixture. The carbon black particles present in the suspension had an average size of 0.5 micron. The composition was prepared by admixing (a) 3.2 parts by weight of an aqueous solution containing 25 parts by weight of ammonium persulfate in 75 parts by weight of water with (b) 20 parts by weight of an aqueous solution containing 2 parts by weight of ammonium laurate in 98 parts by weight of water, and (c) 6.4 parts by weight of "Dylon"* DS insulating carbon coating (a commercially available suspension of 56 parts of weight of amorphous carbon in 44 parts by weight of water), and then adjusting the pH of the mixture to 10 by means of ammonium hydroxide to give 100 parts of mixture.

*"Dylon" is a registered trademark of Dylon Industries.

The fibers treated in this manner were then thermoset by transporting them through a 40-foot long forced air convection furnace at a speed of 6 inches per minute. The furnace contained eight zones, each 5 feet in length, and the fibers were gradually heated from 175° C. in the first or entrance zone to 380° C. in the eighth or exit zone while air was passed through the furnace at a velocity of 4 feet/minute. Total residence time in the furnace was 80 minutes. The fibers produced in this manner were totally infusible. A 3-inch length of the thermoset fibers had a pull strength of 5.1 lbs. and a 12-inch length had a pull strength of 3.1 lbs. (By 3-inch and 12-inch lengths is meant the distance between the pulley and the mandrel of the Mechanical Force Gage employed in the determination.)

The thermoset fibers were then wound on a roller and carbonized by heating them in a nitrogen atmosphere at at temperature of about 2200° C. for 3 seconds. After carbonization, the fibers had a strand tensile strength of 302,000 psi.

EXAMPLE 2

The procedure of Example 1 was repeated employing a colloidal suspension of graphite flour in an aqueous solution of ammonium persulfate and ammonium laurate. The suspension contained 3.6 parts by weight of graphite, 0.8 part by weight of ammonium persulfate, and 0.4 part by weight of ammonium laurate per 100 parts by weight of mixture. The graphite particles present had an average size of 1 micron. This composition was prepared by admixing (a) 3.2 parts by weight of an aqueous solution containing 25 parts by weight of ammonium persulfate in 75 parts by weight of water with (b) 20 parts by weight of an aqueous solution containing 2 parts by weight of ammonium laurate in 98 parts by weight of water, and (c) 16.4 parts by weight of "Aquadag"* micro-graphite colloid in aqueous suspension (a commercially available colloidal suspension of 22 parts by weight of graphite in 78 parts by weight of water), and then adjusting the pH of the mixture to 9.7 by means of ammonium hydroxide to give 100 parts of mixture.

"Aquadag" is a registered trademark of Acheson Colloids Company.

After thermosetting, a 3-inch length of the fibers had a pull strength of 4.7 lbs. and a 12-inch length had a pull strength of 3.8 lbs.

When the procedure was repeated eliminating the ammonium persulfate from the colloidal suspension employed to treat the fibers, a 3-inch length of the thermoset fibers had a pull strength of 2.4 lbs. and a 12-inch length has a pull strength of 1.8 lbs.

What is claimed is:

1. In a process for producing carbon fibers comprising extruding a molten pitch into the form of continuous pitch filaments, combining the pitch filaments into a single multifilament bundle of pitch fibers, thermally stabilizing the pitch fibers by heating the fibers in the presence of an oxidizing gas and then carbonizing the stabilized pitch fibers at elevated temperatures, the improvement whereby substantially all of the pitch fibers in the multifilament bundle are uniformly coated with a mixture containing graphite or carbon black particles and an oxidizing agent, the graphite or carbon black particles serving to separate the pitch fibers in the bundle and thereby to improve penatration of the oxidizing gas, said improvement comprising applying to the pitch fibers in the multifilament bundle prior to thermal stabilization an aqueous finishing composition comprising a dispersion of finely-divided graphite or carbon black particles in water in which is dissolved a first compound comprising a water-soluble oxidizing agent and a separate second compound comprising a water-soluble surfactant.

2. A method as in claim 1 wherein the graphite or carbon black particles are no greater than 15 microns in size.

3. A method as in claim 1 wherein the graphite or carbon black particles are from 0.3 micron to 5 microns in size.

4. A method as in claim 1, 2 or 3 wherein the graphite or carbon black contains less than 0.5 percent by weight of inorganic impurities.

5. A method as in claim 1 wherein the water-soluble oxidizing agent is a peroxygenated compound.

6. A method as in claim 5 wherein the peroxygenated compound is a persulfate.

7. A method as in claim 1 wherein the water-soluble oxidizing agent is selected from the group consisting of sodium peroxide, potassium peroxide, ammonium peroxide, sodium persulfate, potassium persulfate, ammonium persulfate, sodium pyrosulfate, potassium pyrosulfate, ammonium pyrosulfate, sodium perchlorate, potassium perchlorate, ammonium perchlorate, magnesium perchlorate, sodium sulfate, potassium sulfate, ammonium sulfate, sodium sulfite, potassium sulfite, ammonium sulfite, sodium bisulfite, potassium bisulfite, ammonium bisulfite, sodium sulfamate, potassium sulfamate, ammonium sulfamate, sodium nitrate, potassium nitrate, ammonium nitrate, hydrogen peroxide and sulfamic acid.

8. A method as in claim 1 wherein the water-soluble surfactant is an anionic or nonionic surfactant.

9. A method as in claim 8 wherein the water-soluble anionic or nonionic surfactant is selected from the group consisting of tetramethyl sodium oleate, tetramethyl ammonium oleate, tetramethyl sodium laurate, tetramethyl ammonium laurate, sodium laurate and ammonium laurate.

10. A method as in claim 1 wherein the water-soluble oxidizing agent is ammonium persulfate.

11. A method as in claim 1 wherein the water-soluble oxidizing agent is ammonium persulfate and the water-soluble surfactant is ammonium laurate.

12. A process for producing carbon fibers comprising: preparing a molten pitch composition, spinning the molten pitch composition into continuous pitch filaments, combining the pitch filaments into a single multifilament bundle of pitch fibers, applying to the pitch fibers in the multifilament bundle an aqueous dispersion containing from about 0.1 to 10 parts by weight of graphite or carbon black particles per 100 parts by weight of the dispersion, from about 0.1 to 2.0 parts by weight of a water-soluble oxidizing agent selected from the group consisting of peroxides, persulfates, pyrosulfates, perchlorates, sulfates, sulfites, bisulfites, sulfamates and nitrates, per 100 parts by weight of the dispersion and a separate water-soluble surfactant selected from the group consisting of anionic and nonionic surfactants, the surfactant being present in the dispersion in an amount sufficient to impart thereto to surface tension of less than about 50 dynes per centimeter, thermally stabilizing the pitch fibers by heating the multifilament bundle in the presence of an oxidizing gas and then carbonizing the stabilized pitch fibers at elevated temperatures.

* * * * *

UNITED STATES PATENT AND TRADEMARK OFFICE

CERTIFICATE OF CORRECTION

PATENT NO. : 4275051

DATED : June 23, 1981

INVENTOR(S) : John B. Barr

It is certified that error appears in the above—identified patent and that said Letters Patent is hereby corrected as shown below:

Column 5, line 60, "and" should read -- an --.

Column 6, line 37, "at", second occurrence, should read -- a --.

Column 8, claim 12, line 38 "to", second occurrence, should read -- a --.

Signed and Sealed this

*Twentieth* Day of *October 1981*

[SEAL]

*Attest:*

GERALD J. MOSSINGHOFF

*Attesting Officer*

*Commissioner of Patents and Trademarks*